US011988383B2

(12) United States Patent
Nagahama

(10) Patent No.: US 11,988,383 B2
(45) Date of Patent: May 21, 2024

(54) COMBUSTION APPARATUS

(71) Applicant: RINNAI CORPORATION, Aichi (JP)

(72) Inventor: Chihiro Nagahama, Aichi (JP)

(73) Assignee: RINNAI CORPORATION, Aichi (JP)

( * ) Notice: Subject to any disclaimer, the term of this patent is extended or adjusted under 35 U.S.C. 154(b) by 280 days.

(21) Appl. No.: 17/703,707

(22) Filed: Mar. 24, 2022

(65) Prior Publication Data

US 2022/0333773 A1 Oct. 20, 2022

(30) Foreign Application Priority Data

Apr. 19, 2021 (JP) ..... 2021-070192

(51) Int. Cl.
*F23M 5/08* (2006.01)
*F23D 14/10* (2006.01)
*F23L 9/00* (2006.01)

(52) U.S. Cl.
CPC ..... *F23M 5/085* (2013.01); *F23L 9/00* (2013.01); *F23D 14/10* (2013.01)

(58) Field of Classification Search
CPC . F23M 5/085; F23L 9/00; F23D 14/10; F23D 14/045
See application file for complete search history.

(56) References Cited

U.S. PATENT DOCUMENTS 5,875,739 A * 3/1999 Joyce ..... F24H 1/205 122/18.31
7,665,426 B2 * 2/2010 O'Donnell ..... F23C 5/02 431/328
2005/0172915 A1 * 8/2005 O'Donnell ..... F23C 5/02 122/17.1

FOREIGN PATENT DOCUMENTS

JP 2016-125685 A 7/2016

* cited by examiner

*Primary Examiner* — David J Laux
(74) *Attorney, Agent, or Firm* — Future IP LLC; Tomoko Nakajima

(57) ABSTRACT

A combustion chamber inside a combustion box has disposed therein a burner positioning frame having: a rear frame part positioned on a rear side of a burner-disposed portion; and a burner positioning frame having side frame part positioned on each laterally outside of the burner-disposed portion. The rear frame part has formed therein a laterally elongated drawn part which is dented rearward. The secondary air flowing from the distribution holes positioned in such a portion of the partition plate as is closer to the rear end of the partition plate is restrained by the drawn part from flowing upward from between the partition plate and a lower edge of the rear frame part through a clearance between the rear frame part and a rear plate part of the combustion box.

3 Claims, 5 Drawing Sheets

COMBUSTION APPARATUS

This application claims priority under 35 U.S.C. § 119 to Japanese Patent Application No. 2021-070192, filed Apr. 19, 2021, which is incorporated by reference.

TECHNICAL FIELD

The present invention relates to a combustion apparatus comprising: a combustion box having therein: a partition plate for partitioning a space inside the combustion box into a combustion chamber and an air supply chamber below the combustion chamber such that secondary air is supplied from the air supply chamber to the combustion chamber through a multitude of distribution holes formed in the partition plate; and a plurality of longitudinally elongated burners arranged laterally in parallel with each other in the combustion chamber. Each of the burners has, at a lower front end thereof, an inlet port for a fuel gas and primary air to flow and, at an upper end thereof, a burner port through which a mixture of the fuel gas and primary air is ejected.

BACKGROUND ART

In this kind of combustion apparatus there is conventionally known one in which the combustion chamber has disposed therein a burner positioning frame including a rear frame part positioned on a rear side of a burner-disposed portion, and a pair of side frame parts disposed on laterally both outer sides of the burner-disposed portion (for example, see patent document 1). In this arrangement, a lower edge of the rear frame part is positioned above the partition plate. And the lower edge of the rear frame part is bent forward so as to get engaged with a recessed notch part formed in the rear edge part of each of the burners, thereby preventing the burners from getting lifted out of position.

In addition, according to this arrangement, the rear frame part has formed therein a laterally elongated drawn part which is dented rearward toward the rear plate part of the combustion box. Therefore, the secondary air flowing in from the distribution holes positioned in such a portion of the partition plate as is closer to the rear end of the partition plate is restrained by the drawn part from flowing upward from between the partition plate and the lower edge of the rear frame part through a clearance between the rear frame part and the rear plate part of the combustion box. As a result, the secondary air flowing in from the distribution holes positioned in the portion closer to the rear end of the partition plate flows upward along the front surface of the rear frame part such that a heat-shield plate covering an upper inner surface of the rear plate part of the combustion box is cooled by this secondary air.

However, there are sometimes cases where the secondary air that flows in from between the partition plate and the lower edge of the rear frame part into the clearance between the rear frame part and the rear plate part of the combustion box may flow forward, at a lower position of the drawn part, through the clearance between each of the side frame parts and the side plate parts on laterally each side of the combustion box. As a result, the amount of the secondary air that flows upward along the front surface of the rear frame part is reduced, thereby sometimes giving rise to lack of cooling of the heat shield plate.

PRIOR ART DOCUMENT

[Patent Document 1] JP-A-2016-125685

SUMMARY

Problems that the Invention is to Solve

In view of the above points, this invention has a problem of providing a combustion apparatus in which a lack of cooling of the heat shield plate which covers an upper inner surface of the rear plate part of the combustion box can be prevented.

In order to solve the above-mentioned problems, this invention is a combustion apparatus comprising: a combustion box having therein: a partition plate for partitioning a space inside the combustion box into a combustion chamber and an air supply chamber below the combustion chamber such that secondary air is supplied from the air supply chamber to the combustion chamber through a multitude of distribution holes formed in the partition plate; a plurality of longitudinally elongated burners arranged laterally in parallel with each other in the combustion chamber. Each of the burners has, at a lower front end thereof, an inlet port for a fuel gas and primary air to flow in and, at an upper end thereof, a burner port through which a mixture of the fuel gas and primary air is ejected. The combustion chamber: has disposed therein a burner positioning frame including a rear frame part positioned on a rear side of a burner-disposed portion, and a pair of side frame parts disposed on laterally both outer sides of the burner-disposed portion; a lower edge of the rear frame part is positioned above the partition plate; the rear frame part has formed therein a laterally elongated drawn part which is dented rearward toward a rear plate part of the combustion box so that the secondary air flowing from the distribution holes positioned in such a portion of the partition plate as is closer to the rear end of the partition plate is restrained by the drawn part from flowing upward from between the partition plate and the lower edge of the rear frame part through a clearance between the rear frame part and the rear plate part of the combustion box; and consequently the secondary air flowing in from the distribution holes positioned in the portion closer to the rear end of the partition plate flows upward along a front surface of the rear frame part such that a heat-shield plate covering an upper inner surface of the rear plate part of the combustion box is cooled by the secondary air. The above-mentioned combustion apparatus further comprises a restrained part for restraining the secondary air flowing from between the partition plate and the lower edge of the rear frame part into the clearance between the rear frame part and the rear plate part of the combustion box from flowing into a clearance between each of the side frame parts and a side plate part of each of the lateral sides of the combustion box.

According to this invention, the secondary air flowing in from the distribution holes positioned in the portion closer to the rear end of the partition plate is restrained from flowing from between the partition plate and the lower edge of the rear frame part through the clearance between the rear frame part and the rear plate part of the combustion box into the clearance between each of the side frame parts and each of the side plate parts of the combustion box. Therefore, the secondary air that flows upward along the front surface of the rear frame part can be secured in sufficient amount. There can accordingly be prevented insufficient cooling of a shield plate that lies opposite to the upper inner surface of the rear plate part of the combustion box.

Further, in this invention, at a portion closer to a rear end of each of the side frame parts, erected pieces which are erected laterally outward shall preferably be formed so as to constitute the restrained part by the erected pieces. Alternatively, a second drawn part shall preferably be formed in a manner to be dented rearward so as to extend downward from laterally each end part of the drawn part so that the second drawn part constitutes the restrained part.

PREFERRED EMBODIMENTS FOR CARRYING OUT THE INVENTION

Figure 1:
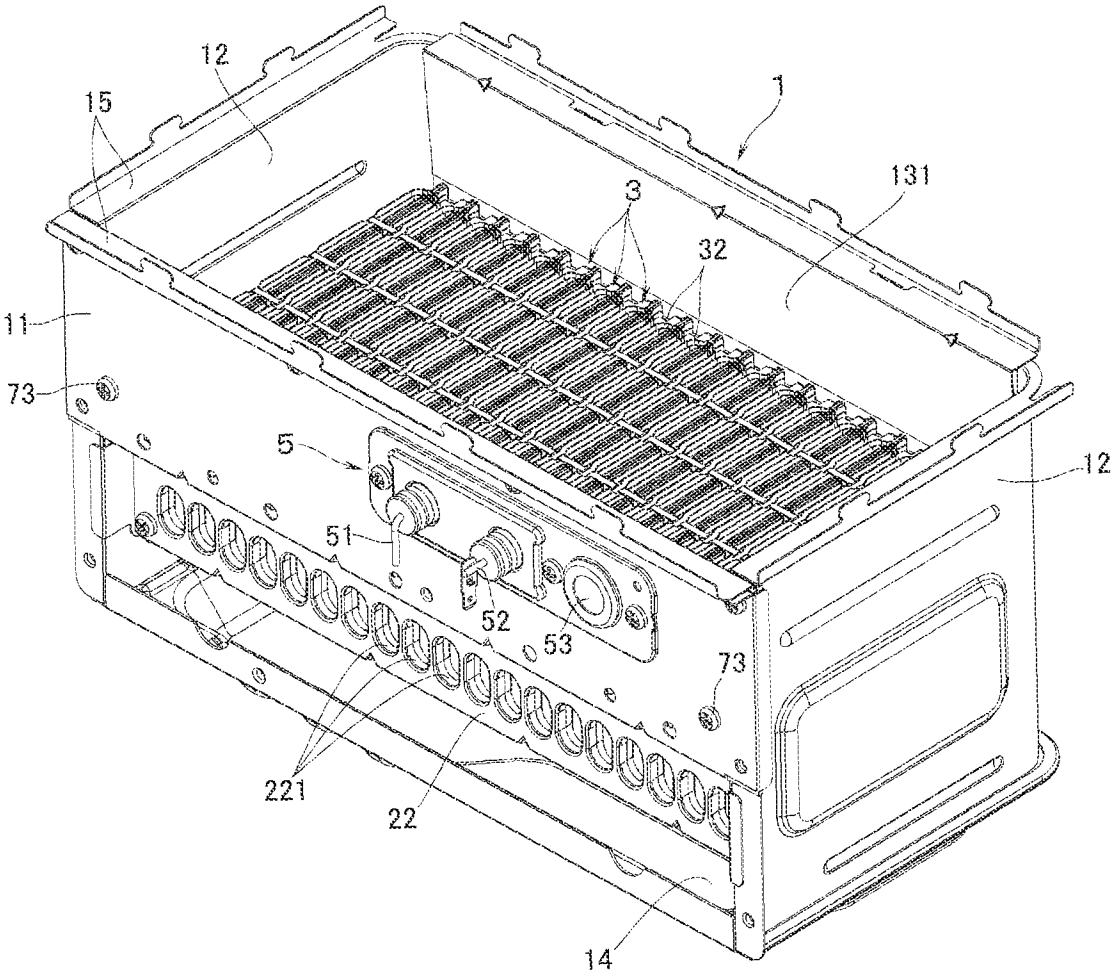
FIG. 1 is a perspective view of a combustion apparatus according to an embodiment of this invention.
Figure 2:
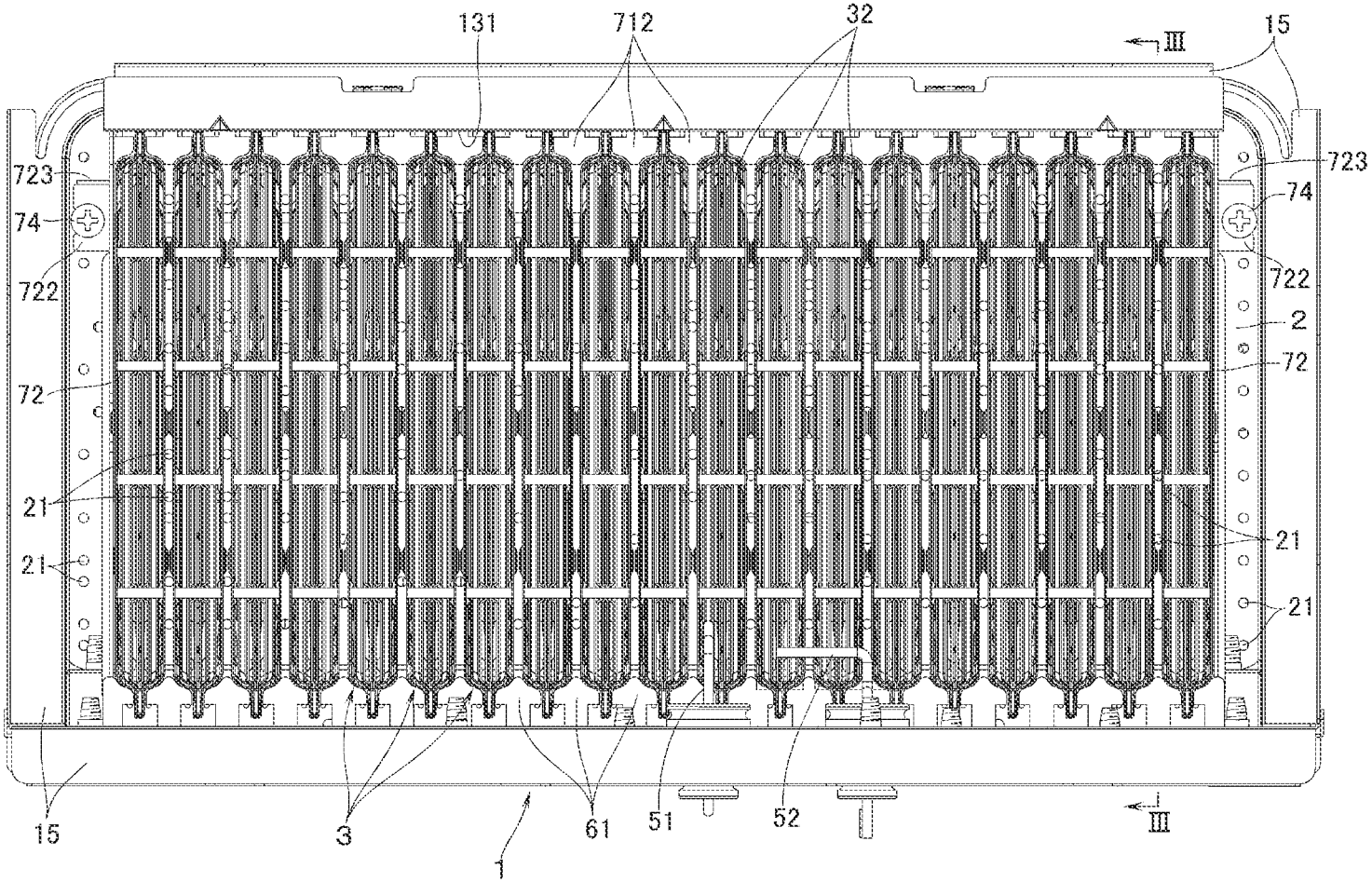
FIG. 2 is a plan view of the combustion apparatus according to the embodiment.
Figure 3:
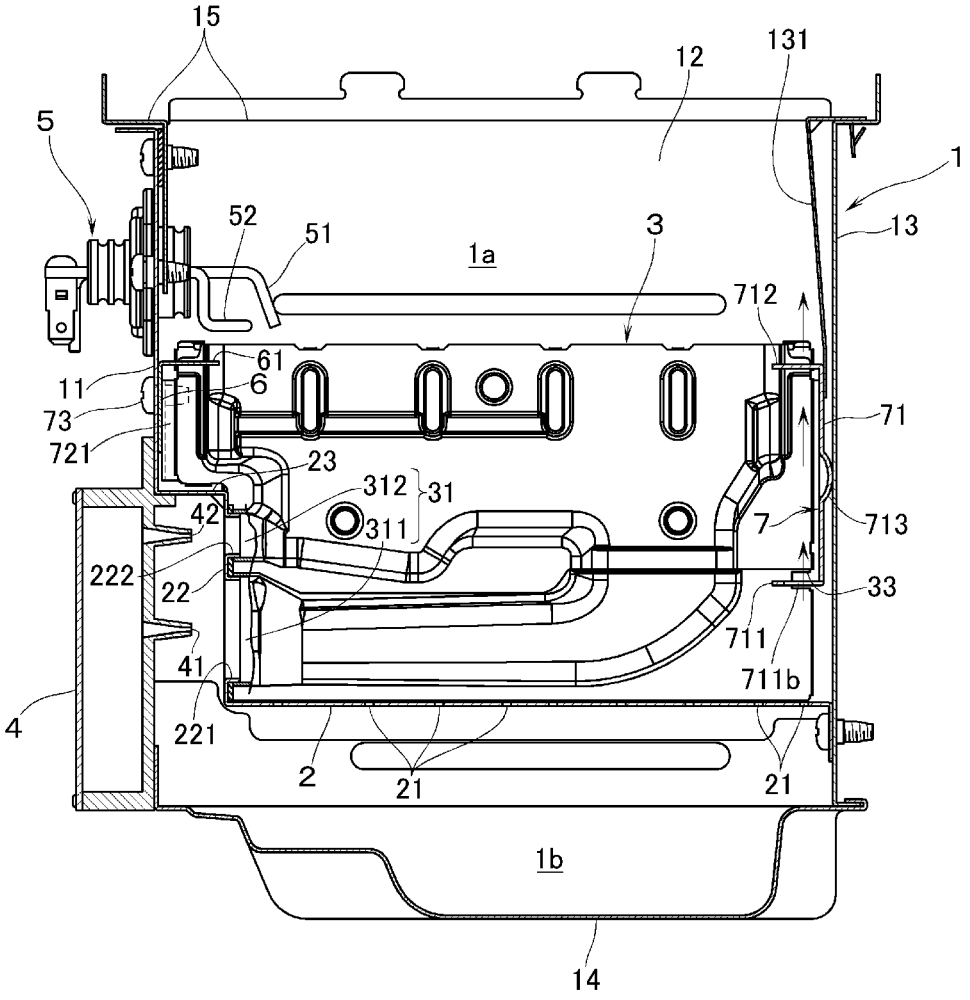
FIG. 3 is a sectional side view taken along the line III-III in FIG. 2.

With reference to FIGS. 1 to 3, the combustion apparatus according to an embodiment of this invention is provided with a combustion box 1. The combustion box 1 has: a front plate part 11 on a front upper portion; side plate parts 12, 12 on laterally both sides; a rear plate part 13; and a bottom plate part 14. Further, the combustion box 1 has at an upper end a coupling flange part 15 for connecting thereto a heat exchanger (not illustrated) for hot water supply and the like. Further, inside the combustion box 1 there is disposed a partition plate 2 for partitioning the space inside the combustion box 1 into a combustion chamber 1*a* and an air supply chamber 1*b* on the lower side of the combustion chamber 1*a*. To the bottom surface of the air supply chamber 1*b*, i.e., to the bottom plate part 14 there is connected a fan (not illustrated). It is thus so arranged that the air from the fan is supplied from the air supply chamber 1*b* as the secondary air to the combustion chamber 1*a* through a multiplicity of distribution holes 21 formed in the partition plate 2.

Figure 4:
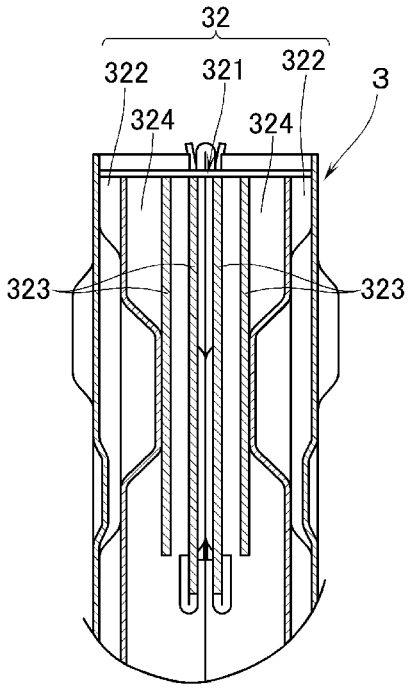
FIG. 4 is a sectional view of a burner port portion which is disposed in the combustion apparatus according to the embodiment.

In the combustion chamber 1*a*, there are provided with a plurality of longitudinally elongated burners 3 arranged laterally in parallel with each other. Each of the burners 3 has, at a lower front end, an inlet port 31 for a fuel gas and primary air to flow in and has, at an upper end, a burner port 32 through which a mixture of the fuel gas and primary air is ejected. The burner port 32 is, as shown in FIG. 4, constituted by: a thin burner port 321 for ejecting thin air-fuel mixture which is thinner in fuel concentration than the theoretical air-fuel ratio; and a pair of thick burner ports 322, 322, positioned on both laterally outside of the thin burner port 321, for ejecting thick air-fuel mixture which is thicker in fuel concentration than the thin air-fuel mixture. In addition, inside the thin burner port 321 there are mounted a plurality of ventilation straightening plate 323 at a lateral distance from one another. Further, on both sides of the thin burner port 321, there are disposed recycling regions 324 which are free from ejection of the air-fuel mixture. At the front lower end of the burner 3, there are disposed, as inlet port 31, a first inlet port 311 which is in communication with the thin burner port 321 and a second inlet port 312 which is positioned on an upper side of the first inlet port 311 and which is in communication with the thick burner port 322 as shown in FIG. 2.

At a front end of the partition plate 2 there are disposed: an erected plate part 22 which is elongated upward; and an upper plate part 23 which is bent forward from an upper end of the erected plate part 22 so as to reach the front plate part 11 of the combustion box 1. By the way, in this embodiment, the front end of the upper plate part 23 is bent upward to thereby integrally form the front plate part 11. The erected plate part 22 has formed therein openings 221, 222 that coincide with the first and the second inlet ports 311, 312 of each of the burners 3. Further, toward the front of the erected plate part 22 there is mounted a manifold 4 in a manner to close the lower front surface of the combustion box 1. The manifold 4 is provided with the first and the second gas nozzles 41, 42 which face the first and the second inlet ports 311, 312 of each of the burners 3. In this manner, it is so arranged that: the fuel gas is supplied from each of the first and the second gas nozzles 41, 42 to each of the inlet ports 311, 312; and the primary air is supplied from the air supply chamber 1*b* to each of the inlet ports 311, 312 through the clearance to be defined between the erected plate part 22 and the manifold 4.

The front plate part 11 of the combustion box 1 has mounted thereon an electrode part 5 which has an ignition electrode 51 and a flame rod 52 and an inspection window 53. Still furthermore, on an inner surface of the front plate part 11, a burner positioning plate 6 is disposed. At an upper end of the burner positioning plate 6 there are formed, in a bent manner, a plurality of claw pieces 61 which are inserted into a clearance between front end parts of each of the burners 3.

Figure 5:
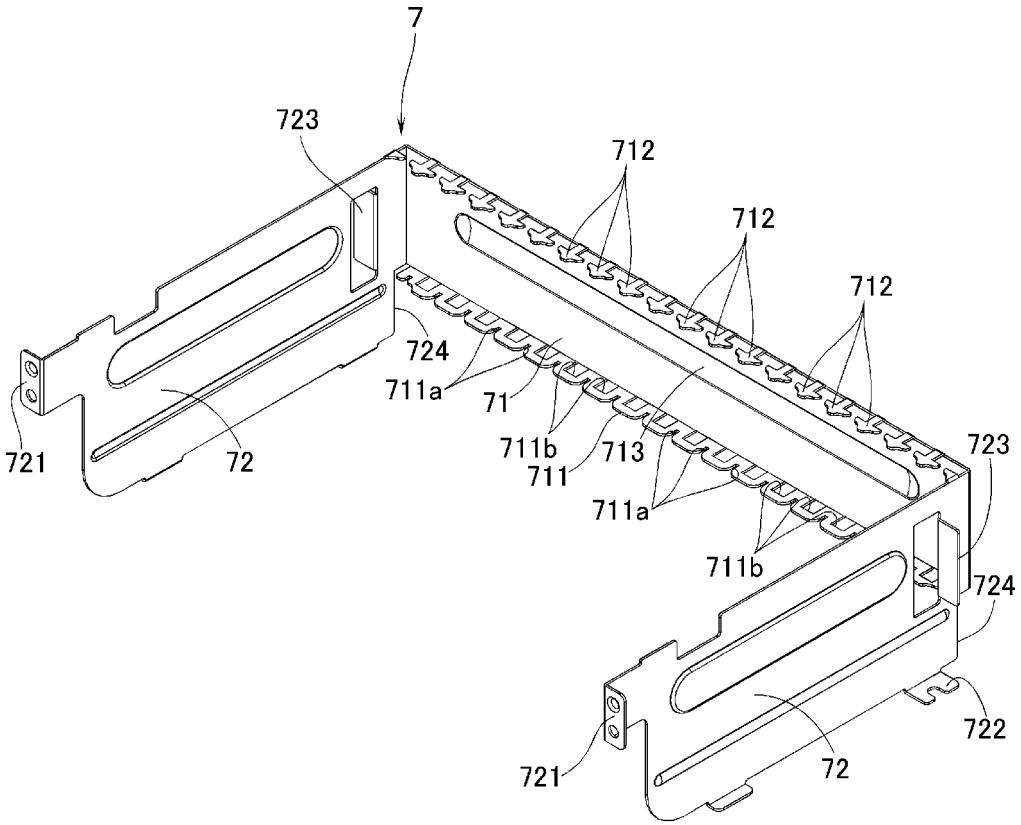
FIG. 5 is a perspective view, as seen from a slantingly forward, of a burner positioning frame which is disposed in the combustion apparatus according to the embodiment.

Further, the combustion chamber 1*a* has disposed therein a burner positioning frame 7. With reference also to FIG. 5, the burner positioning frame 7 has: a rear frame part 71 which is positioned on the rear side of the burner-disposed portion (i.e., a portion in which the burners are arranged); and a pair of side frame parts 72, 72 which are positioned on both laterally outside of the burner-disposed portion. The burner positioning frame 7 is fastened with screws 73 at flange parts 721 which are formed in a bent manner at the front end of each of the side frame parts 72. The burner positioning frame 7 is also fastened with screws 74 to tongue parts 722 which are extended at rear parts of lower edge of each of the side frame parts 72.

The lower edge 711 of the rear frame part 71 is positioned above the partition plate 2. Then, the lower edge 711 thereof is bent forward so as to get engaged with a recessed notch part 33 formed at the rear edge of each of the burners 3. The burners 3 are thus respectively prevented from getting lifted out of position. In addition, at an upper end of the rear frame part 71 there are formed in a bent manner a plurality of claw pieces 712 which are to be inserted into a clearance between rear end parts of each of the burners 3. Further, at a lower edge 711 of the rear frame part 71, there are formed slits 711*a* into which is engaged such a portion of each of the burners 3 as is dented forward at the recessed notch parts 33 of the rear edge part of each of the burners 3, so that each of the burners 3 can be fixed in position.

At a lower edge 711 of the rear frame part 71, there are further formed draft holes 711*b* positioned between the slits 711*a*, 711*a*. The secondary air that flows through distribution holes 21 positioned in such a portion of the partition plate 2 as is closer to the rear end of the partition plate 2 flows upward, as shown by an arrow in FIG. 3, along the front surface of the rear frame part 71. This secondary air is arranged to flow, through the clearance between each of the claw pieces 712, 712, upward along the front surface of a heat shield plate 131 which covers an upper inner surface of the rear plate part 13 of the combustion box 1. Therefore, the heat shield plate 131 is cooled by this secondary air.

Here, it is to be noted that, since the lower edge 711 of the rear frame part 71 is positioned above the partition plate 2, there is a possibility that the secondary air that flows from the distribution holes 21 positioned in the portion closer to the rear end portion of the partition plate 2, flows from between the partition plate 2 and the lower edge 711 of the rear frame part 71 into a clearance between the rear frame part 71 and the rear plate part 13 of the combustion box 1. If this secondary air flows upward through the clearance between the rear frame part 71 and the rear plate part 13 of the combustion box 1, the amount of the secondary air that flows upward along the front surface of the rear frame part 71 will be reduced. As a result, the heat shield plate 131 can no longer be sufficiently cooled. As a solution, the rear frame part 71 has formed therein a laterally elongated drawn part 713 which is dented rearward toward the rear plate part 13 of the combustion box 1. It is thus so arranged that the secondary air flowing from the distribution holes 21 positioned in the portion closer to the rear end of the partition plate 2 can be restrained, by the drawn part 713, from flowing upward from between the partition plate 2 and the lower edge 711 of the rear frame part 71 through the clearance between the rear frame part 71 and the rear plate part 13 of the combustion box 1.

However, only by forming the drawn part 713 alone will give rise to the following disadvantages. Namely, the secondary air that flows from between the partition plate 2 and the lower edge 711 of the rear frame part 71 into the clearance between the rear frame part 71 and the rear plate part 13 of the combustion box 1 will sometimes flow, at a position below the drawn part 713, forward through a clearance between each of the side frame parts 72 of the burner positioning frame 7 and the side plate 12 on each lateral side of the combustion box 1. As a result, the amount of the secondary air that flows upward along the front surface of the rear frame part 71 will be reduced, thereby giving rise to the shortage of cooling of the heat shield plate 131.

As a solution, according to this embodiment, there is disposed a restrained part 723 to restrain the secondary air, that flows from between the partition plate 2 and the lower edge 711 of the rear frame part 71 into the clearance between the rear frame part 71 and the rear plate part 13 of the combustion box 1, from flowing into the clearance, at a position below the drawn part 713, between each of the side frame parts 72 and the side plate part 12 on each lateral side of the combustion box 1. In concrete, at a portion closer to a rear end of each of the side frame parts 72, erected pieces 723 which are erected laterally outward are formed so as to constitute the restrained part by the erected pieces 723.

According to this arrangement, the erected pieces 723 can restrain the secondary air, flowing from the distribution holes 21 positioned in the portion closer to the rear end of the partition plate 2, from flowing from between the partition plate 2 and the lower edge 711 of the rear frame part 71 through the clearance between the rear frame part 71 and the rear plate part 13 of the combustion box 1 into the clearance between each of the side frame parts 72 and each of the side plate parts 12 of the combustion box 1. Therefore, it is possible to secure sufficient amount of secondary air that flows upward along the front surface of the rear frame part 71, thereby preventing the lack of cooling of the heat shield plate 131.

Figure 6:
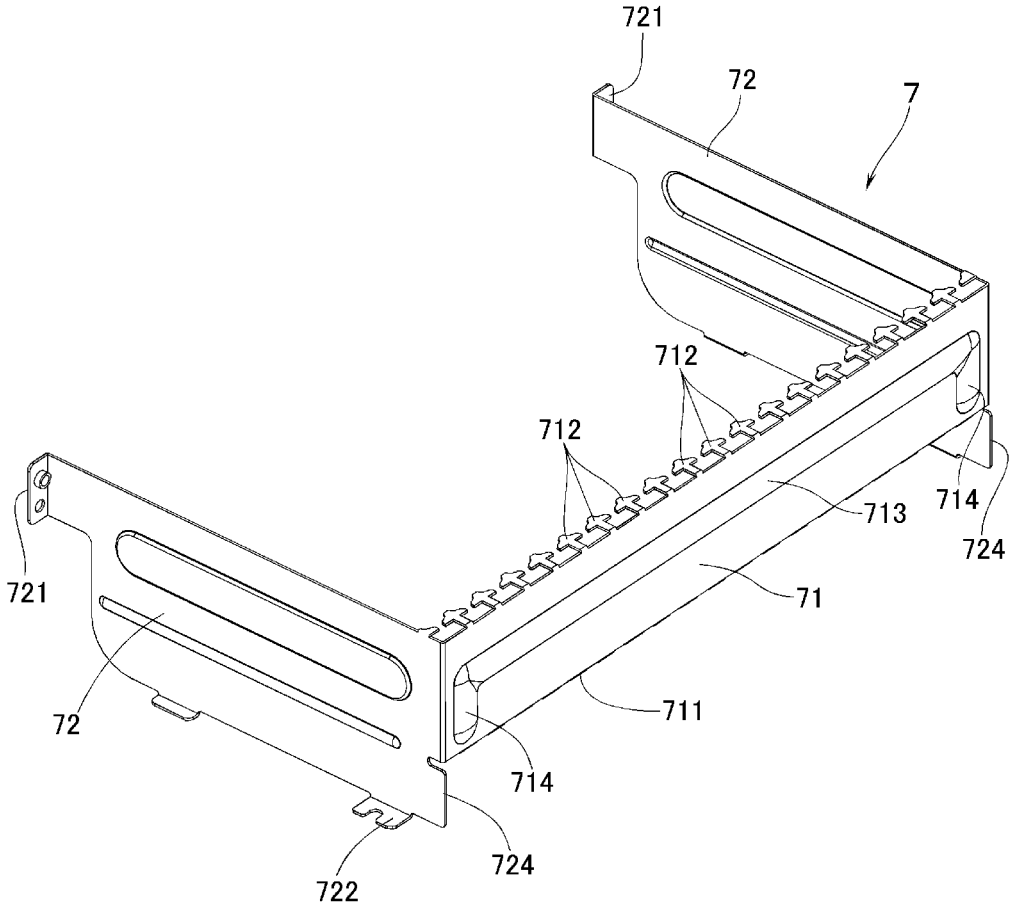
FIG. 6 is a perspective view of a modified example of the burner positioning frame.

Next, with reference to FIG. 6, a description will be made of a modified embodiment of the burner positioning frame 7. The basic construction of this burner positioning frame 7 of this modified embodiment is not particularly different from the burner positioning frame 7 of the above-mentioned embodiment, and the same reference marks have been assigned to similar members, parts, etc. as in the above-mentioned embodiment. The difference between the above-mentioned embodiment of the burner positioning frame 7 and the modified embodiment is that, without forming the erected pieces 723 in each of the side frame parts 72, the rear frame part 71 has formed therein a second drawn part 714 which is elongated from each of lateral end part of the drawn part 713 downward and which is dented rearward. The second drawn parts 714 constitute the restrained part.

According to the above arrangement, the secondary air flowing into the clearance between the rear frame part 71 and the rear plate part 13 of the combustion box 1 is trapped, at a position below the drawn part 713, between the second drawn parts 714, 714 on both lateral sides. Accordingly, the second drawn part 714 can restrain the secondary air that flows into the clearance between the rear frame part 71 and the rear plate part 13 of the combustion box 1, at the position below the drawn part 713, from flowing into the clearance between each of the side frame parts 12 and each of the lateral side plate parts 12 of the combustion box 1. In other words, the second drawn parts 714 will constitute the restrained part.

In addition, in the burner positioning frame 7 as shown in FIG. 5, a rear end 724 of the lower half part 724 of each of the side frame parts 72 is positioned slightly ahead of the longitudinal position of the rear frame part 71. In the burner positioning frame 7 as shown in FIG. 6, on the other hand, the longitudinal position of the rear end 724 of the lower half part of each of the side frame parts 72 is equivalent to the longitudinal position of the rear frame part 71. According to this arrangement, the secondary air that flows in from the distribution holes 21 positioned in the portion closer to the rear end of the partition plate 2 can be restrained from flowing, at a position below the rear frame part 71, into the clearance between each of the side frame parts 72 and each of the lateral side plate parts 12 of the combustion box 1.

Descriptions have so far been made of embodiments of this invention with reference to the drawings, but this invention shall not be limited to the above. For example, it is also possible to mount, on the burner positioning frame 7, another member which serves to be the above-mentioned restrained part. However, as in the above-mentioned embodiments, by constituting the restrained part by the erected piece 723 and the second drawn part 714, the restrained part can be constituted without increasing the number of constituting parts, to the advantage of reducing the cost. In addition, in the above-mentioned embodiments, the burner 3 is constituted by a so-called thick and thin burner having thin burner ports 321 and thick burner ports 322, but the burner 3 may also be constituted by an ordinary Bunsen burner in which the thick burner port 322 is omitted.

EXPLANATION OF MARKS

1 combustion box
1*a* combustion chamber
1*b* air supply chamber
13 rear plate part

131 heat shield plate
2 partition plate
21 distribution hole
3 burner
31 inlet port
32 burner port
7 burner positioning frame
71 rear frame part
711 lower edge of rear frame part
713 drawn part
714 second drawn part (restrained part)
72 side frame part
723 erected piece (restrained part)

The invention claimed is:

1. A combustion apparatus comprising:

a combustion box having therein: a partition plate for partitioning a space inside the combustion box into a combustion chamber and an air supply chamber below the combustion chamber such that secondary air is supplied from the air supply chamber to the combustion chamber through a multitude of distribution holes formed in the partition plate; a plurality of longitudinally elongated burners arranged laterally in parallel with each other in the combustion chamber; each of the burners having, at a lower part front end thereof, an inlet port for a fuel gas and primary air to flow in and, at an upper end thereof, a burner port through which a mixture of the fuel gas and primary air is ejected, the combustion chamber: having disposed therein a burner positioning frame including a rear frame part positioned on a rear side of a burner-disposed portion, and a pair of side frame parts disposed on laterally both outer sides of the burner-disposed portion; a lower edge of the rear frame part being positioned above the partition plate; the rear frame part having formed therein a laterally elongated drawn part which is dented rearward toward a rear plate part of the combustion box so that the secondary air flowing in from the distribution holes positioned in such a portion of the partition plate as is closer to the rear end of the partition plate is restrained by the drawn part from flowing upward from between the partition plate and the lower edge of the rear frame part through a clearance between the rear frame part and the rear plate part of the combustion box; and consequently the secondary air flowing in from the distribution holes positioned in the portion closer to the rear end of the partition plate flows upward along a front surface of the rear frame part such that a heat-shield plate covering an upper inner surface of the rear plate part of the combustion box is cooled by the secondary air;

wherein the combustion apparatus further comprises a restrained part for restraining the secondary air flowing from between the partition plate and a lower edge of the rear frame part into the clearance between the rear frame part and the rear plate part of the combustion box from flowing into a clearance between each of the side frame parts and the side plate part of each of the lateral sides of the combustion box.

2. The combustion apparatus according to claim 1, wherein at a portion closer to a rear end of each of the side frame parts, erected pieces which are erected laterally outward are formed so as to constitute the restrained part by the erected pieces.

3. The combustion apparatus according to claim 1, wherein at the rear frame part, a second drawn part is formed in a manner to be dented rearward so as to extend downward from laterally each end part of the drawn part, the second drawn part constituting the restrained part.

* * * * *